United States Patent [19]

Milburn et al.

[11] 4,147,489

[45] Apr. 3, 1979

[54] POWDER COMPACTING PRESSES

[75] Inventors: George Milburn; John Chetter, both of Lytham St. Annes, England

[73] Assignee: British Nuclear Fuels Ltd., Warrington, England

[21] Appl. No.: 823,194

[22] Filed: Aug. 9, 1977

[30] Foreign Application Priority Data

Jun. 22, 1977 [GB] United Kingdom ..... 26164/77

[51] Int. Cl.[2] ..... B30B 11/04

[52] U.S. Cl. ..... 425/355; 425/DIG. 35

[58] Field of Search ..... 425/78, 354, 355, DIG. 115, 425/107, 450.1, DIG. 221, DIG. 222, DIG. 223

[56] References Cited

U.S. PATENT DOCUMENTS

| | | | |
|---|---|---|---|
| 84,284 | 11/1868 | Klinkhardt et al. | 425/107 X |
| 2,404,559 | 7/1946 | Ashbaugh | 425/354 X |
| 2,431,095 | 11/1947 | Tucker | 425/355 X |
| 3,029,752 | 4/1962 | Frank | 425/107 |
| 3,132,379 | 5/1964 | Crane | 425/DIG. 115 |
| 3,366,368 | 1/1968 | Hibbing | 425/355 X |
| 3,414,940 | 12/1968 | Vinson | 425/78 |
| 3,676,030 | 7/1972 | Roepenack et al. | 425/78 |

OTHER PUBLICATIONS

Larson, Taylor and Hinds

*Primary Examiner*—J. Howard Flint, Jr.

[57] ABSTRACT

A press for compacting powders in which a first plunger is moved into a stationary die to meter and charge powder to be compacted into the die from one end of the die, a second plunger is advanced towards the first plunger to compact the powder within the die and the first plunger is then used to push the compacted powder from the other end of the die.

The press may be used to make pellets of ceramic nuclear fuel material.

4 Claims, 5 Drawing Figures

POWDER COMPACTING PRESSES

BACKGROUND TO THE INVENTION

This invention relates generally to presses for compacting powder into shapes, and particularly but not exclusively to such presses for the compaction of ceramic nuclear fuel powder into pellets which are to be stacked in sealed containers forming part of nuclear fuel assemblies for nuclear reactors.

Although commercially available powder presses can be adapted for use with ceramic nuclear fuel powder, it has proved difficult to provide against loss of powder due to the fact that the compacts are removed from the press dies in a direction against the inward flow of powder, necessitating complicated die filling devices such as shoes or sweep arms which are difficult to seal against loss of feed powder. Most commercial presses are used for confectionery or with other common and inexpensive powders so that some loss of powder is acceptable, but where the powder is a fissile ceramic material, particularly one containing plutonium, any loss of powder is to be avoided, on cost, safety and security grounds.

Commercial presses fall into two general kinds, the mechanical press, with its set stroke, and the hydraulic. The mechanical kind provides compacts of constant depth but green density is variable unless constant fill is effective, and this requires very expensive metering mechanism. The hydraulic press enables a close control over green density, but this is at the expense of constant depth unless the said expensive constant fill is provided. Because constant green density is important so that subsequent diameter grinding after sintering is reduced or eliminated, hydraulic pressing is necessary to compensate for die fill variation. Other variants affecting green density are intergranular and die-wall friction, and entrapped air. Intergranular friction has a small effect on green density variation compared with die wall friction but often granules are lubricated to provide the die wall lubrication required. Die wall lubrication separately is a much more economical operation and does not introduce contaminants into the granules. Provided the depth/diameter ratio is not too large and if ample time is allowed for a compaction cycle, variations of green density due to entrapped air can also be reduced to negligible proportions. By reducing or eliminating green density variation, diameter grinding, which is expensive and time consuming, can be reduced or eliminated.

SUMMARY OF THE INVENTION

It is therefore an object of the present invention to provide a powder compacting press not subject to the difficulties and shortcomings set forth in the preceding paragraphs. p According to the invention, a press for compacting powder into a shape comprises a stationary cylindrical die, a support frame movable relative to the stationary die, a first plunger rigidly mounted on the support frame and located on the same axis as the cylindrical die so as to be movable into and through the die as the support frame moves relative to the die, a second plunger mounted on the support frame on the same axis as the first plunger and movable relative to said support frame so as to advance towards and retract away from the first plunger, means for feeding a powder to be compacted to one end of the die, means for moving the support frame to advance the first plunger into the die so that the powder to be compacted is metered and charged into the die from said one end of the die by the first plunger, and means for advancing the second plunger towards the first plunger within the die to compact the powder therebetween, the means for moving the support frame also being able to further advance the first plunger relative to the die after the second plunger has been advanced towards the first plunger to compact the powder therebetween so that the compacted powder is ejected from the other end of said die by the first plunger.

In order that the press may be used to produce annular pellets the first plunger may be provided with an axial bore containing a core rod which is urged towards a position in which it extends from the first plunger and contacts the second plunger when the first and second plungers are within the die.

The press may also include provision for the removal of the support frame, plungers and die. To this end the press may further comprise a fixed support member on which the die is releasably supported and in which the support frame is slidably received and a casing enclosing the means for advancing the second plunger towards the first plunger releasably connected to the support frame and movable relative to the support member, the second plunger being biased away from the first plunger so that when the support frame is connected to the casing the second plunger contacts the means for advancing the second plunger, the arrangement being such that the support frame, the plungers and the die can be removed from the press.

When used for the compaction of powders of a fissile material it is desirable to prevent egress of the powder from the press. Therefore, a flexible member for preventing the egress of powder from the press maybe provided between the fixed support member and the casing.

BRIEF DESCRIPTION OF THE DRAWINGS

The invention will be illustrated by the following description of a press for the compaction of powder given by way of example only; the description has reference to the accompanying drawings in which.

DETAILED DESCRIPTION ON ONE EMBODIMENT OF THE INVENTION

Figure 1:
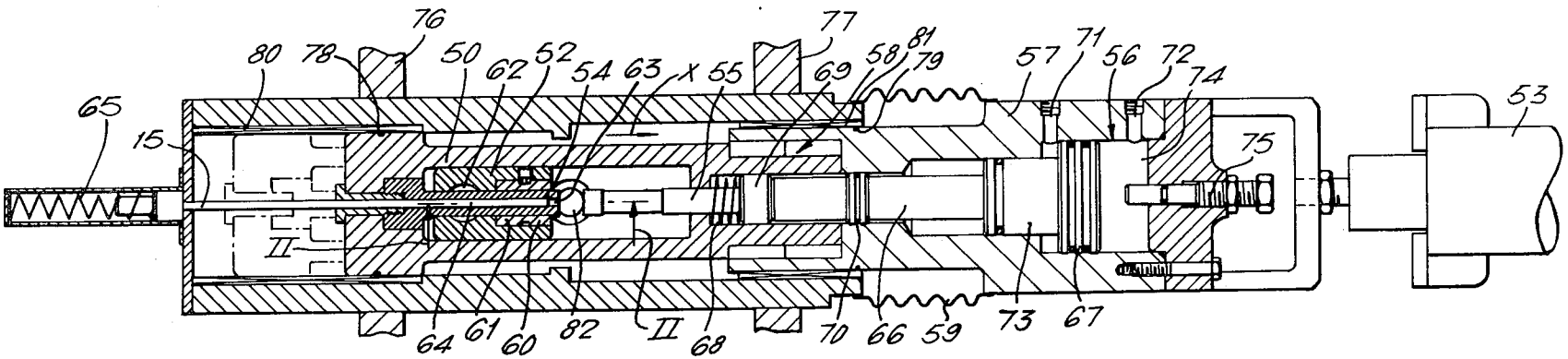
FIG. 1 is a cross-sectional view of a press for compacting powders.

Referring now to FIG. 1 a press for compacting of powders into compacts comprises an inner frame 50, slidably supported in a fixed outer frame 51 which outer frame releasably supports a stationary die block 52. The inner frame 50 is moved within the outer frame 51 by means of a double acting pneumatic cylinder 53. The inner frame 50 supports a fixed plunger 54 and has a movable plunger 55 which is moved axially towards and away from the fixed plunger 54 within the inner frame by means of a double acting hydraulic cylinder 56 located inside a casing 57 which is releasably connected to the inner frame 50 by a bayonet connection 58. A flexible bellows 59 links the fixed outer frame and the casing 57.

The die block 52 has a cylindrical die 60 into which the fixed and movable plungers 54, 55 can fit, the die being formed by a tubular insert 61 of a hard material such as tungsten carbide. The tubular insert may be replaced should it become worn. The die block also has a hopper 62 through which the powder to be compacted is fed to the die.

The fixed plunger 54 has an axial bore 63 in which is located a core rod 64 which is urged towards the die block 52 by a spring 65. The core rod 61 enables the press to be used to manufacture annular pellets.

The movable plunger 55 is urged away from the die block 52 and into contact with an extension 66 projecting from the piston 67 of the hydraulic cylinder 56 by a spring 68. The extension 66 extends from the casing 57 into a blind bore in the bayonet connection 58 on the inner frame 50 and the spring 68 urges a block 69 at the end of the movable plunger 55 remote from the die block 52 into abutment with the end of the extension 66. The extension 66 is provided with a seal 70 to prevent ingress of powder from the compacting region into the casing 57. The casing 57 is provided with ports 71, 72 to permit hydraulic fluid to pass into and out of the chambers 73, 74 of the double acting hydraulic cylinder and an adjustable stop 75 to limit the movement of the piston 67.

The particular embodiment shown in FIG. 1 is suitable for the compacting of powders of ceramic nuclear fuel material (such as the oxides of uranium and/or plutonium) into compacts which are termed pellets in the art. When fissile materials are being compacted it is necessary to contain any powder to avoid contamination of the area surrounding the press. To this end the outer frame 51 is mounted within a containment region defined by walls 76, 77 and seals 78, 79 are provided on the inner frame 50 and casing 57 where they contact bearing surfaces 80, 81 on the outer frame 51. The seals 78, 79 along with the seal 70 on the extension 66 prevent egress of powder from the containment region.

The bayonet connection 58 permits the separation of the inner frame 50 from the casing 57. Before the inner frame can be removed the core rod 64 has to be withdrawn and the die block 52 has to be released from the outer frame 51. Rotation of the inner frame 50 disengages the bayonet connection and permits the removal of the inner frame 50 and the die block 52. After removal any maintenance required on the inner frame 50, die block 52 and punches 54, 55 may be performed.

Figure 2:
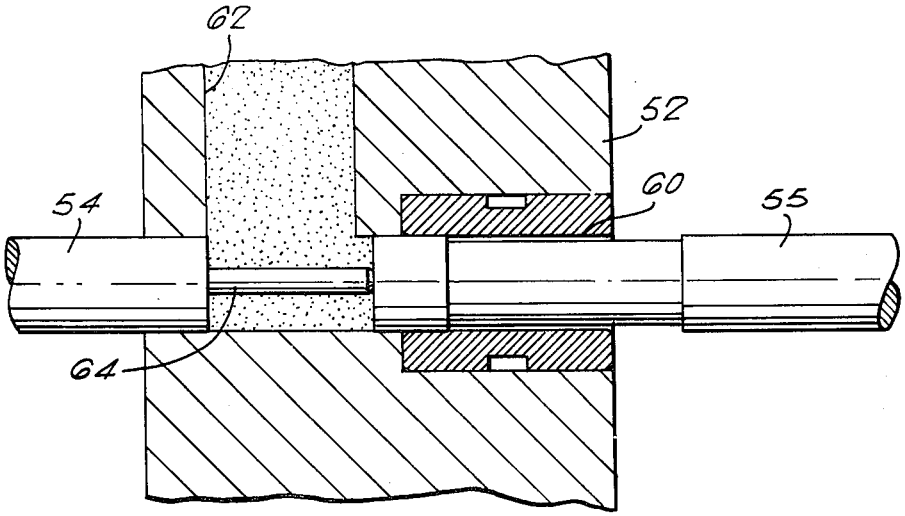
FIGS. 2 to 5 are views taken along the line II—II of FIG. 1 each illustrating a step in the operating cycle of the press of FIG. 1.
Figure 3:
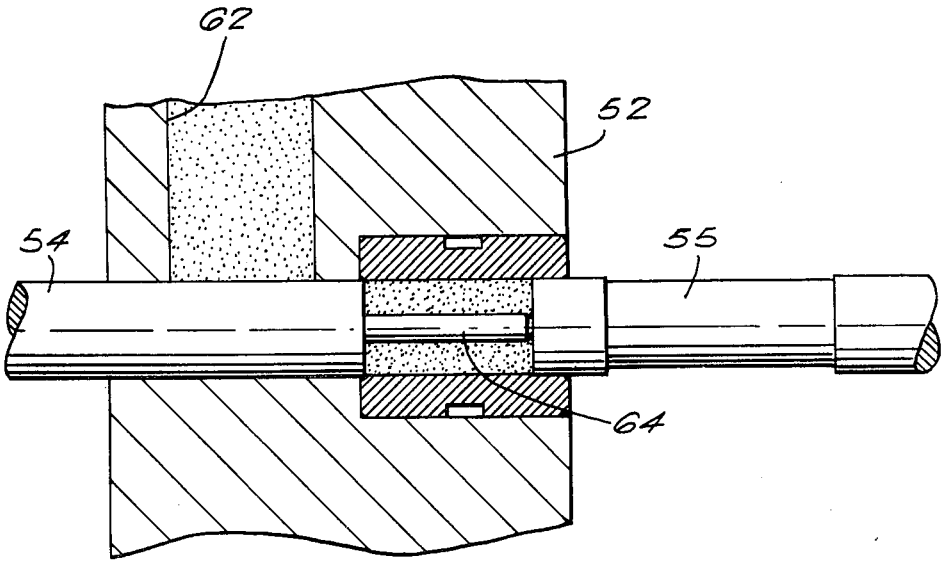
Figure 4:
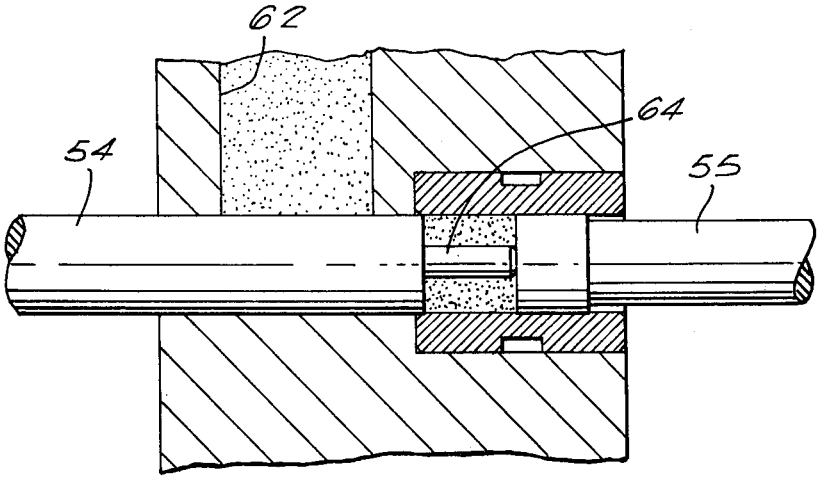
Figure 5:
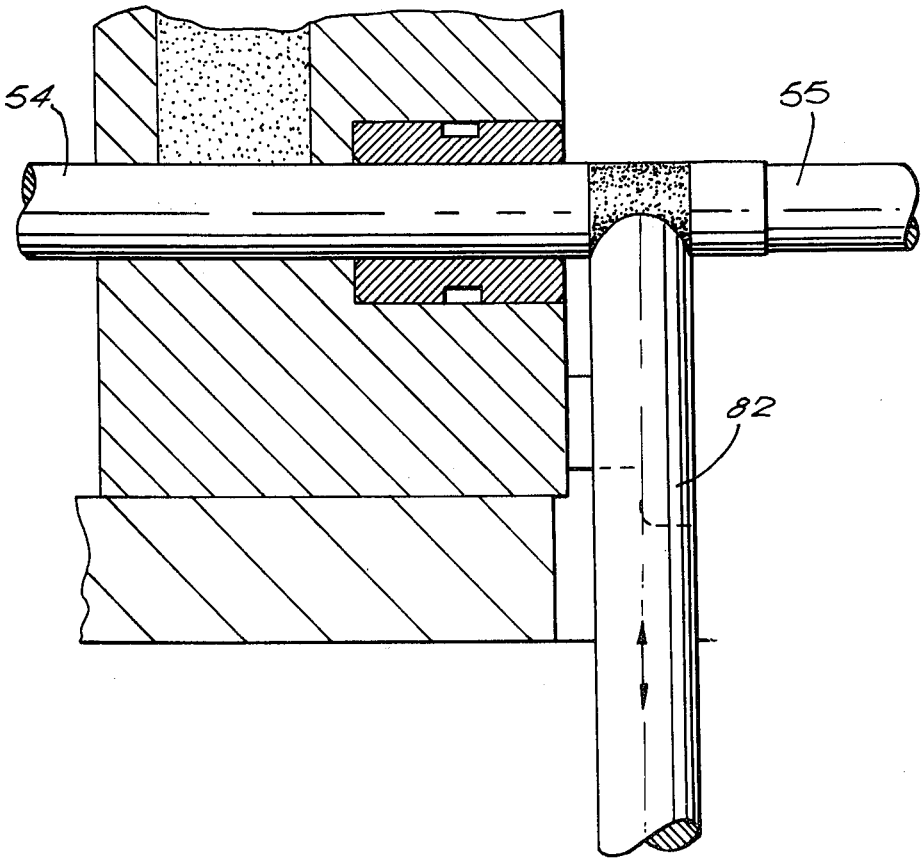

The operation of the press to produce annular pellets will now be described with particular reference to FIGS. 2 to 5 of the drawings. The operating cycle commences with the inner frame 50 at the position shown by the dotted lines in FIG. 1 (which position will be termed the advanced position of the pneumatic cylinder 53). As shown in FIG. 2 the end of the fixed plunger 54 is then aligned with one wall of the hopper 62. The spring 65 urges the core rod 64 to extend beyond the face of the fixed plunger 54 to contact the movable plunger 55 which is located within the die block 52. The inner frame 50 is then withdrawn in the direction of the arrow X in FIG. 1 by the pneumatic cylinder 53 without altering the position of the piston 67 in the hydraulic cylinder 56 so that a charge of powder is carried from the hopper 62 into the die 60 (as shown in FIG. 3). As the movable plunger 55 moves through the die the spring 65 continues to urge the core rod 64 into contact with the movable plunger 55. Hydraulic fluid is then admitted to the chamber 74 of the hydraulic cylinder 56 to cause the movable plunger 55 to be urged towards the fixed plunger within the die (FIG. 4) to compact the powder into an annular pellet. The air cylinder is then fully retracted in the direction of the arrow X in FIG. 1 to the position shown in full lines in FIG. 1 and in FIG. 5. The compacted pellet is therefore drawn out of the die. The position of the piston 67 with respect to the hydraulic cylinder 56 does not alter and so the compacted pellet is kept under compression as it is moved out of the die. The core rod 64 may extend under the influence of the spring 65 only to the end of the die 60 and therefore the annular pellet can be removed by a reciprocating pellet collecting ram 82 when the compressive force applied by the plungers is released. The pneumatic cylinder is then fully advanced so that a further compacting cycle can commence.

The above description illustrates a single press. However several such presses may be mounted together in a production unit where additional output is required. These presses may be operated by a common pneumatic cylinder performing the function of the cylinder 53 described above. Alternatively, the function of the cylinder 53 may be performed by a mechanical or electrical device which moves the inner frame 50 within the outer frame 51. Each of the presses would however retain independent control because each press would have its own hydraulic cylinder similar to 56.

The pneumatic cylinder 53 may be filled with oil actuated by pneumatic pressure on the oil reservoirs to allow fine control of the speeds.

The use of one of the plungers to meter and charge the powder to be compacted into the die and the use of hydraulic pressing to compact the powder in the press described above facilitates the manufacture of pellets having little or no variation in green density.

We claim:

1. A pelleting press for compacting powders into a shape comprising a stationary cylindrical die, a support frame movable relative to the stationary die, a first plunger rigidly mounted on the support frame and located on the same axis as the cylindrical die so as to be movable into and through the die as the support frame moves relative to the die, a second plunger mounted on the support frame on the same axis as the first plunger and movable relative to said support frame so as to advance towards and retract away from the first plunger, means for feeding a powder to be compacted to one end of the die, means for moving the support frame to advance the first plunger into the die so that the powder to be compacted is metered and charged into the die from said one end of the die by the first plunger, means for advancing the second plunger towards the first plunger within the die to compact the powder therebetween, said second plunger moving relative to the support frame whilst the support frame is stationary relative to the die, the means for moving the support frame also being able to cause further advancement of the first plunger relative to the die so that the first plunger passes through the die, the second plunger being stationary relative to the support frame during said further advancement, and said further advancement occurring after the second plunger has been advanced towards the first plunger to compact the powder therebetween so that the compacted powder is held between the first and second plungers and is ejected from the other end of said die by the first plunger.

2. A pelleting press for compacting powders as claimed in claim 1 wherein the first plunger has an axial bore containing a core rod which is urged towards a position in which it extends from the first plunger and contacts the second plunger when the first and second plungers are within the die.

3. A press for compacting powders as claimed in claim 1 further comprising a fixed support member on which the die is releasably supported and in which the support frame is slidably received, and a casing enclosing the means for advancing the second plunger towards the first plunger releasably connected to the support frame and movable relative to the support member, the second plunger being biased away from the first plunger so that when the support frame is connected to the casing the second plunger contacts the means for advancing the second plunger, the arrangement being such that the support frame, the plungers and the die can be removed from the press.

4. A press for compacting powder as claimed in claim 3 wherein a flexible member for preventing the egress of powder from the press is provided between the fixed support member and the casing.

* * * * *